US007412751B2

(12) United States Patent
Forrest

(10) Patent No.: US 7,412,751 B2
(45) Date of Patent: Aug. 19, 2008

(54) DOORSTOP

(76) Inventor: Paul Bradley Forrest, 511 Dundalk Way, Cary, NC (US) 27511

( * ) Notice: Subject to any disclaimer, the term of this patent is extended or adjusted under 35 U.S.C. 154(b) by 123 days.

(21) Appl. No.: 11/176,413

(22) Filed: Jul. 7, 2005

(65) Prior Publication Data

US 2007/0006419 A1 Jan. 11, 2007

(51) Int. Cl.
*E05F 5/02* (2006.01)

(52) U.S. Cl. ..... 16/82; 16/85

(58) Field of Classification Search ..... 16/82, 16/84–85, 86 R, 86 A; 292/DIG. 19, 251.5, 292/DIG. 8, 338; 267/220, 292; 248/205.6, 248/205.7

See application file for complete search history.

(56) References Cited

U.S. PATENT DOCUMENTS

| | | | | |
|---|---|---|---|---|
| 918,060 | A | 4/1909 | Kabureck | |
| 1,481,582 | A * | 1/1924 | Woolliscroft | 16/84 |
| 2,068,928 | A * | 1/1937 | Paolillo | 16/86 A |
| 2,189,048 | A | 2/1940 | Underhill | |
| 2,700,788 | A | 2/1955 | Hennelly | |
| D178,366 | S | 7/1956 | Heyer | |
| 2,760,224 | A | 8/1956 | Hennelly | |
| 2,767,421 | A | 10/1956 | Fremstad | |
| 3,025,559 | A * | 3/1962 | Basinger | 16/85 |
| 3,172,144 | A | 3/1965 | Jamison | |
| 3,180,666 | A * | 4/1965 | Jorgensen | 292/70 |
| 3,386,125 | A * | 6/1968 | Hand | 16/86 R |
| 3,824,649 | A * | 7/1974 | Kempf | 16/86 A |
| 4,218,807 | A * | 8/1980 | Snow | 16/86 A |
| 4,782,553 | A | 11/1988 | Morrison | |
| 5,082,317 | A | 1/1992 | Delaney, Jr. | |
| 5,517,721 | A * | 5/1996 | Roth et al. | 16/86 R |
| D388,696 | S | 1/1998 | Troy | |
| 5,761,766 | A | 6/1998 | Basham | |
| 6,296,237 | B1 * | 10/2001 | Nagai | 267/220 |

FOREIGN PATENT DOCUMENTS

| | | | |
|---|---|---|---|
| EP | 1258589 | A1 * | 11/2002 |
| GB | 2180297 | A * | 3/1987 |

* cited by examiner

*Primary Examiner*—Chuck Y. Mah
(74) *Attorney, Agent, or Firm*—Coats & Bennett, P.L.L.C.

(57) ABSTRACT

A doorstop comprises a unitary body made of a resilient material including an elongate shank having a longitudinal axis, a tip at one end of said elongate shank, and a base at the opposite end of said elongate shank. A flexible wall connects said elongate shank to said base and is designed to flex in response to impact by a door along the longitudinal axis to absorb the impact of said door.

15 Claims, 13 Drawing Sheets

DOORSTOP

BACKGROUND OF THE INVENTION

The present invention relates generally to doorstops for preventing a door from swinging back against a wall, and more particularly, to a flexible, wall mounted doorstop to absorb the impact of the swinging door.

One conventional type of doorstop comprises a rigid shank with a cushioned top at one end and a screw at the other end adapted to be threaded into the wall. Such rigid doorstops have a number of disadvantages. If the door swings back against the wall with sufficient force, the rigid doorstop may damage the door notwithstanding the cushioned tip. Further, a rigid doorstop does not yield when impacted from the side. When hit with sufficient force, the doorstop can be ripped from the wall. Another disadvantage of a conventional rigid doorstop is that the cushioned tip can sometimes separate from the shank, which increases the likelihood of damage to the door.

Flexible doorstops are also known. One common type of flexible doorstop is similar to the rigid doorstop, except that the rigid shank is replaced by a coil spring. Flexible doorstops reduce damage to the door, but often bend or buckle under the impact of a door, thus allowing the door to strike the wall. If the impact force is severe, the coil spring may be deformed so that the doorstop does not return to its original position. As with the rigid doorstop, the cushioned tip of flexible doorstops can separate.

Accordingly, there is a need for an improved doorstop that can absorb the impact from a swinging door, that will yield when impacted from the side and return to its original position, and is constructed of a single piece so that parts will not separate.

SUMMARY OF THE INVENTION

The present invention comprises a doorstop having a unitary body molded as a single piece. The unitary body comprises an elongate shank having a tip at one end for engaging the door and a base at the opposite end for mounting the body to a wall surface. A flexible wall or membrane connects the shank with the base. The membrane is designed to flex in response to axial impact forces, such as when the door swings back against the doorstop. In one embodiment, the flexible wall buckles outwardly responsive to axial impact forces to allow the elongate shank to axially compress. In another embodiment, the flexible wall includes a crease or fold that travels along the wall in response to axial impact forces to allow the elongate shank to move axially downward into the base in response to axial impact forces. The flexible wall also allows the elongate shank to fold back against the wall responsive to lateral impact forces. Some embodiments of the invention may include an air chamber or air pocket to dampen axial impact forces. Some embodiments may also include internal bumpers that engage the wall surface when the elongate shank is axially compressed to prevent the doorknob of the door from striking the wall. The body can be mounted to the wall surface by means of an adhesive disk or pad, screws that extend through screw holes in the base, or other suitable mounting means.

DETAILED DESCRIPTION OF THE INVENTION

Figure 1:
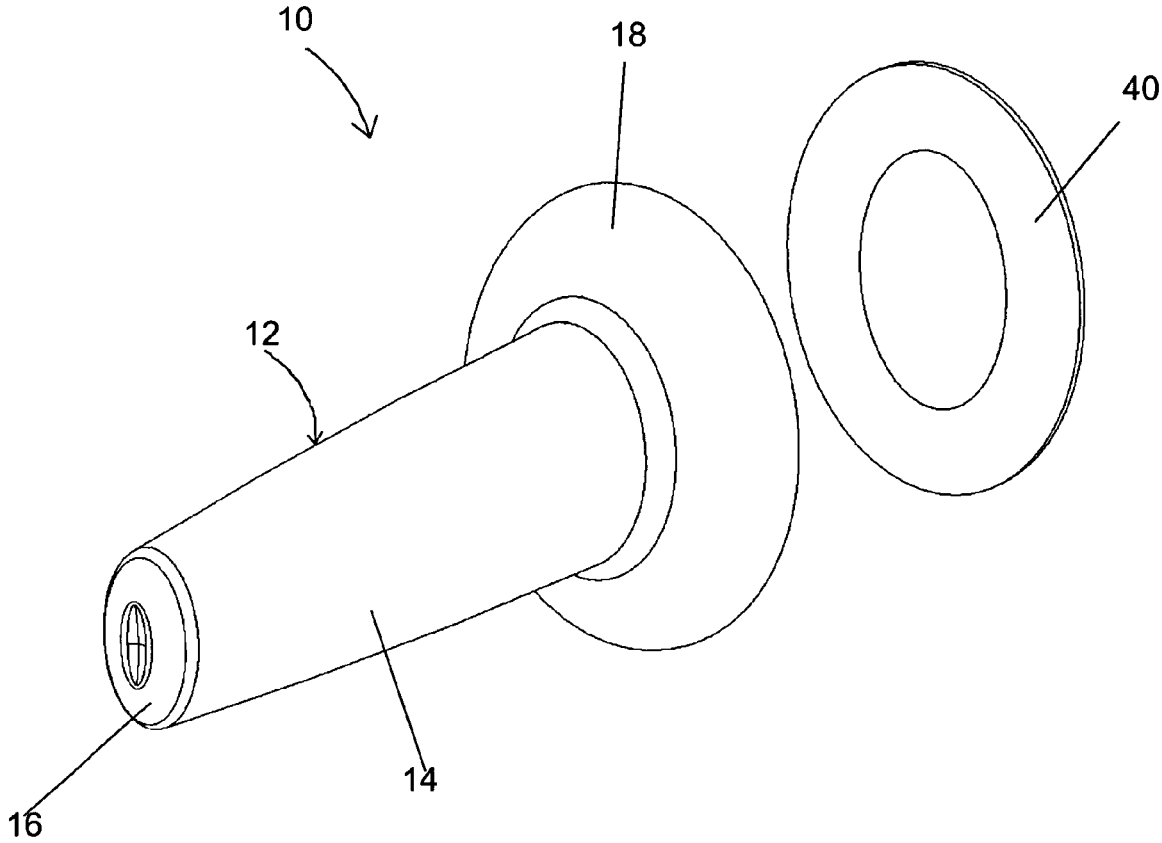
FIG. 1 is a perspective view of a doorstop according to a first exemplary embodiment of the invention.
Figure 3:
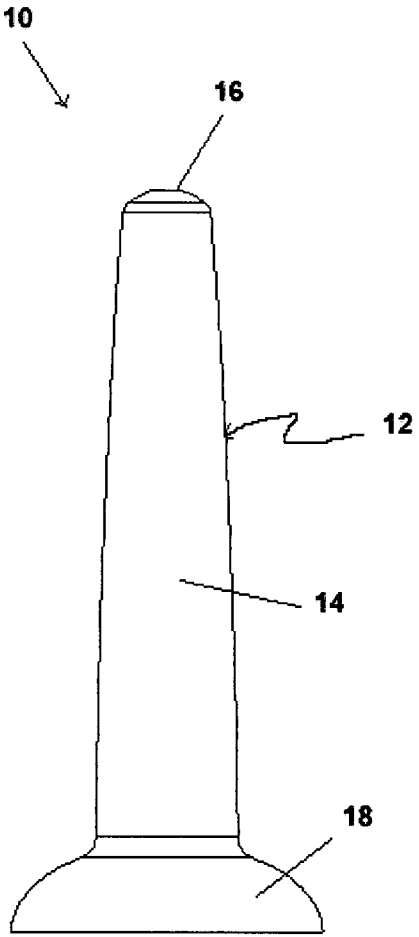
FIG. 3 is a side elevational view of the first embodiment of the doorstop.
Figure 2:
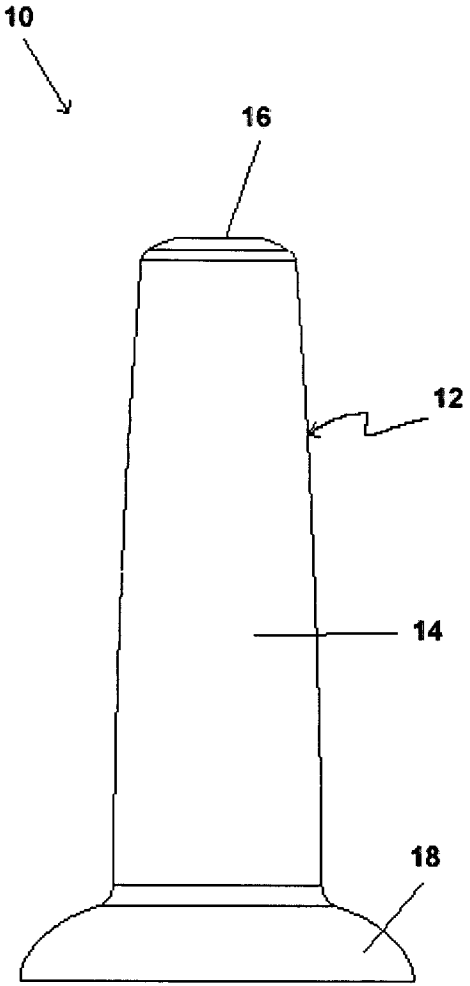
FIG. 2 is a side elevational view of the first embodiment of the doorstop.
Figure 5:
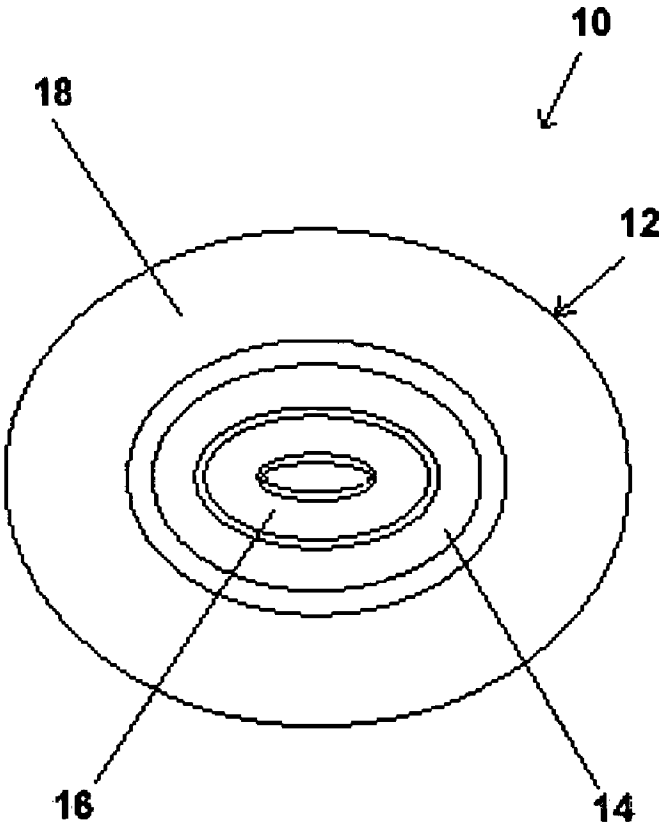
FIG. 5 is a top view of the first embodiment of the doorstop.

Referring now to the drawings, exemplary embodiments of a flexible doorstop, indicated generally by the numeral 10, are shown therein. The doorstop 10 comprises a unitary body 12 made of a resilient material such as a natural or synthetic rubber, or a thermoplastic elastomer. The unitary body 12 comprises a tapered shank 14 with an oval cross section, a convex tip 16 for engaging a door that swings back toward a wall surface, and a base 18 for mounting the doorstop 10 on a wall surface adjacent a doorway. Doorstop 10 may be mounted to the wall surface, for example, by means of a double-sided adhesive disk 40 that adheres to a bottom surface 22 of the base 18 and to the wall surface.

Figure 7:
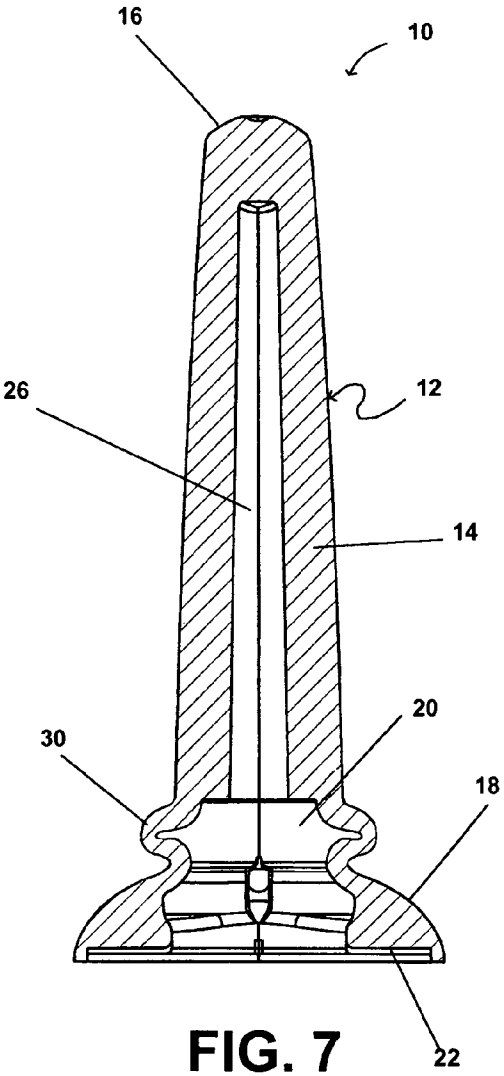
FIG. 7 is a longitudinal section view of the first embodiment of the doorstop in an axially compressed position.
Figure 6:
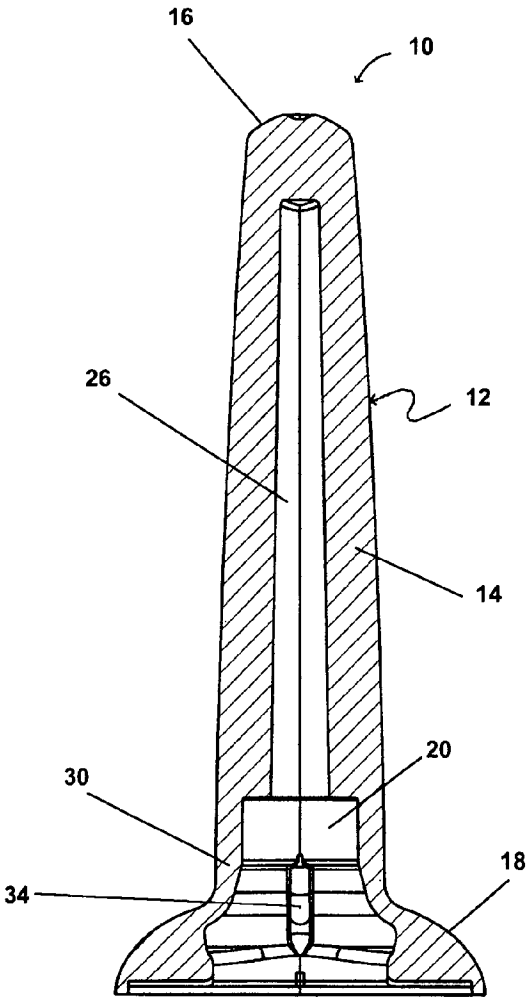
FIG. 6 is a longitudinal section view of the first embodiment of the doorstop in a normal uncompressed position.

FIGS. 1 through 8 illustrate a first embodiment of the doorstop 10. In this embodiment, an air chamber 20 is formed in the unitary body as shown in FIGS. 6 and 7. The air chamber 20 extends from the base 18 into the elongate shank 14. The shank 14 may also have an axial bore 26 extending from the air chamber 20 towards the tip 16. The axial bore 26 reduces the amount of material in the shank 14 and decreases the weight of the doorstop 10.

Figure 4:
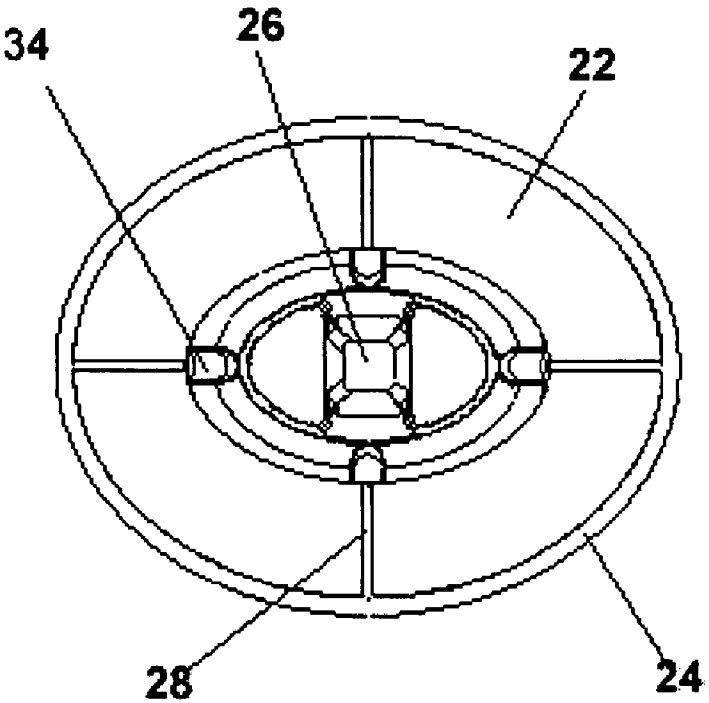
FIG. 4 is a bottom view of the first embodiment of the doorstop.

A flexible wall 30 connects the elongate shank 14 with the base 18. The flexible wall 30 is designed to buckle, as shown in FIG. 7, in response to axial loads along the longitudinal axis allowing the shank 14 to axially compress. Axial compression of the doorstop 10 reduces the interior volume of the doorstop 10 so air is forced out of the air chamber 20. Air passages 28, as shown in FIG. 4, may be formed in the bottom surface 22 of the base 18 to provide a path for air to flow out of and into the air chamber 20. The air passages 28 are designed to restrict the flow of air out of the air chamber 20 responsive to axial loads to provide a dampening or cushioning effect. When the axial forces compressing the shank 14 are removed, the natural resiliency of the flexible wall 30 returns the shank 14 to an uncompressed state as shown in FIG. 6. Support ribs 34 are formed on the wall of the air chamber 20. The function of the support ribs 34 is to provide sufficient strength to the flexible wall 30 to return the shank 14 to its original position after being compressed or deformed.

The bottom surface 22 of the base 18 may be recessed, as shown most clearly in FIGS. 6 and 7, to accommodate an adhesive mounting disk or pad 40. The bottom surface 22 is surrounded by an annular lip 24. The mounting disk 40 has adhesive on both the top and bottom sides. The top surface of the adhesive mounting disk 40 adheres to the bottom surface 22 of the doorstop 10, and the bottom surface of the adhesive mounting pad 40 adheres to the wall to secure the doorstop 10 to the wall. The annular lip 24 surrounding the bottom surface 22 conceals the adhesive mounting disk 40 and provides a finished appearance.

Figure 8:
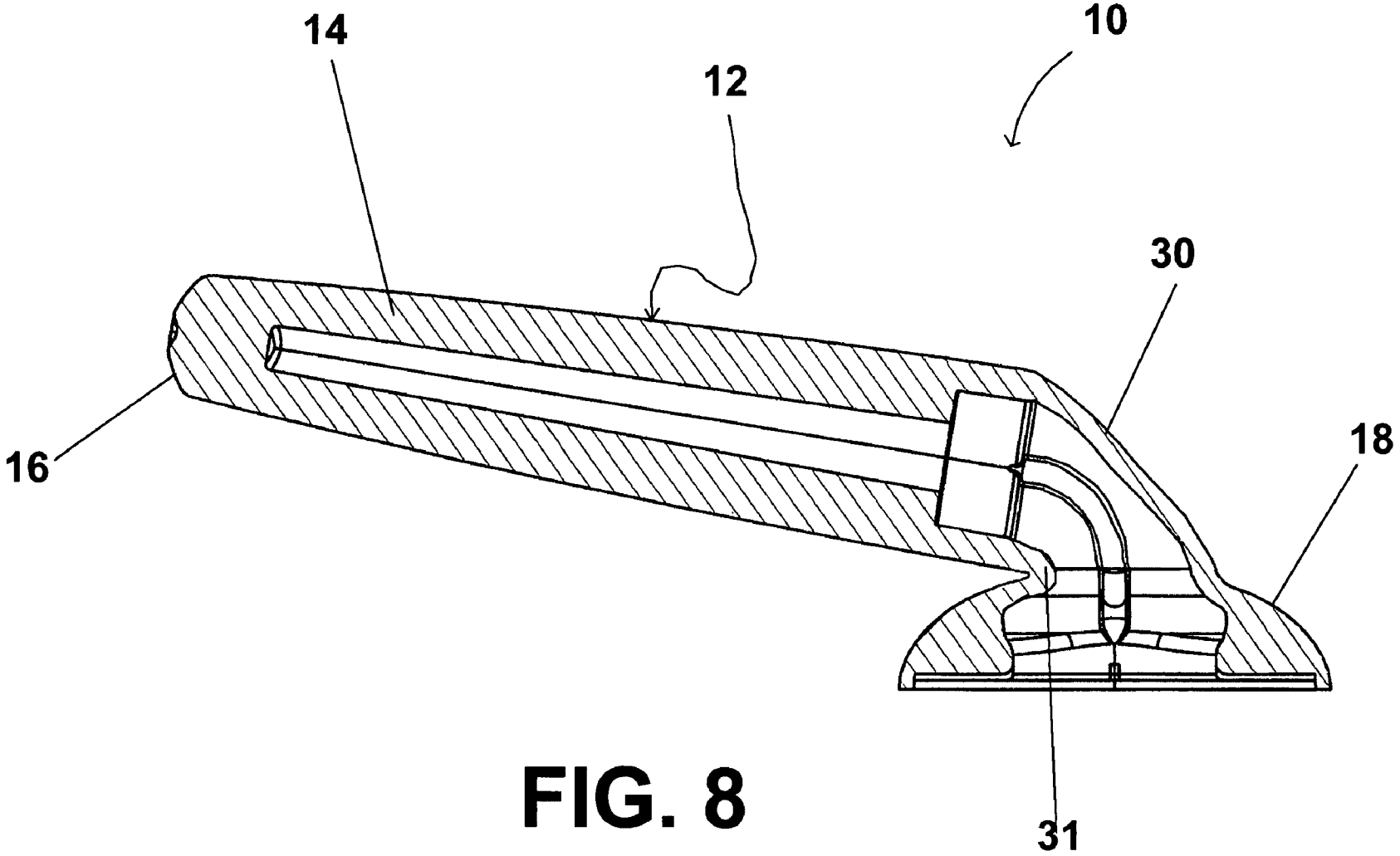
FIG. 8 is a longitudinal section view of the doorstop shown in FIG. 1 showing the doorstop folded over sideways in response to a lateral impact.
Figure 9:
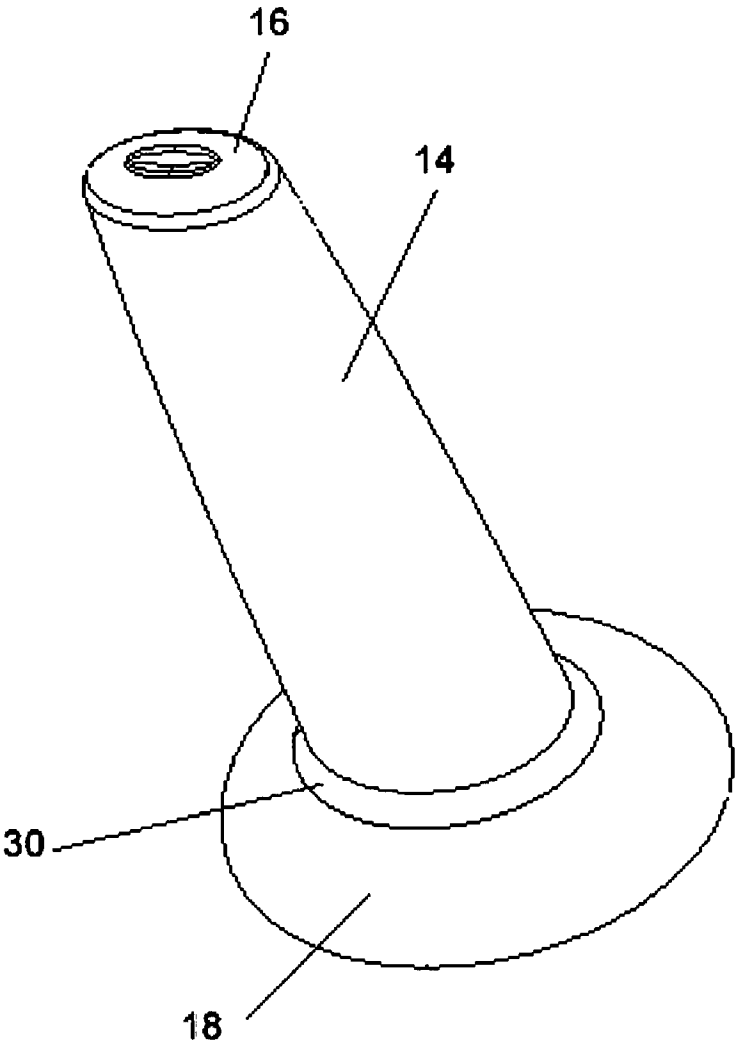
FIGS. 9 and 10 are perspective views of a second exemplary embodiment of the doorstop.
Figure 10:
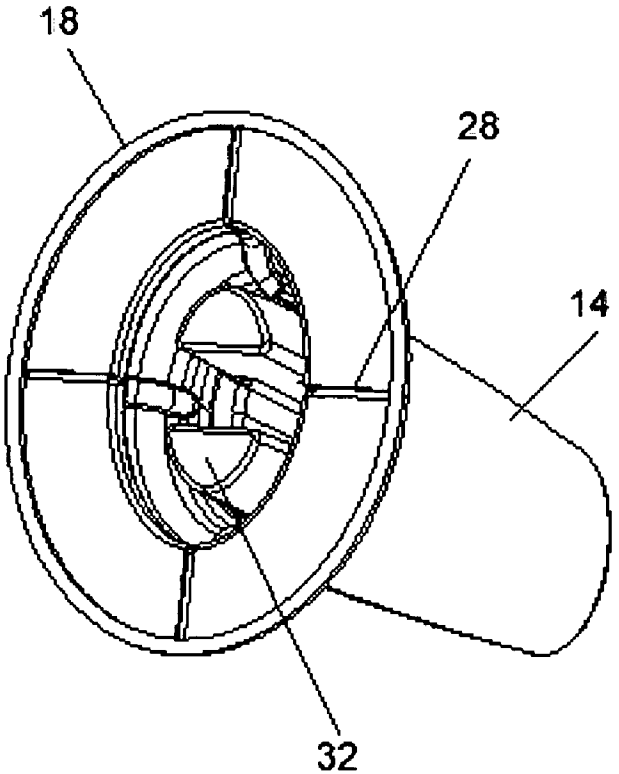
Figure 12:
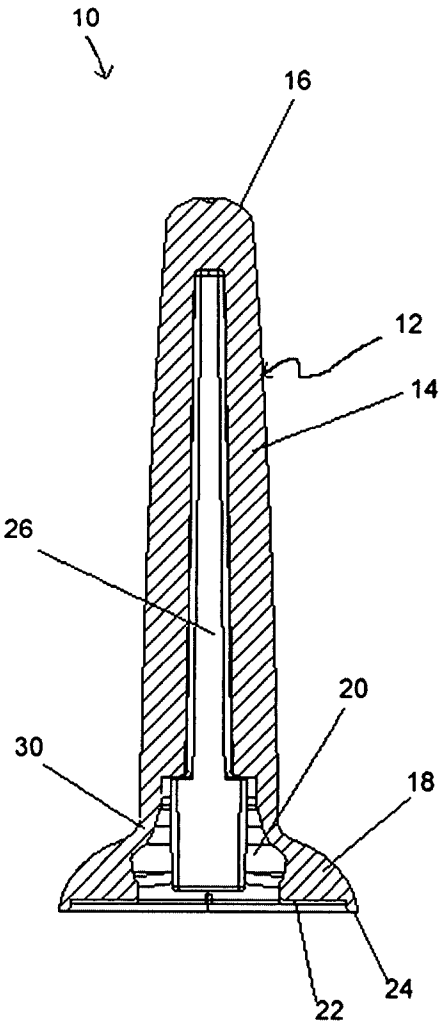
FIGS. 11 and 12 are longitudinal section views of a doorstop according to a second exemplary embodiment in a normal uncompressed position.
Figure 11:
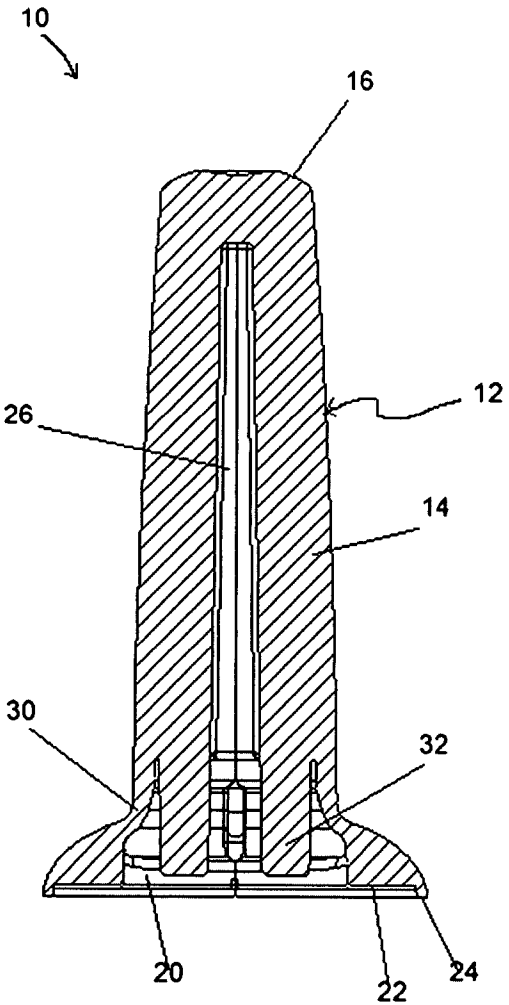

FIG. 8 illustrates how the doorstop 10 yields to lateral impact forces. When lateral impact forces are applied to the shank 14 of the doorstop 10, the flexible wall 30 allows the shank 14 to fold back against the wall. When the lateral force is removed, the natural resiliency of the flexible wall 30 causes the shank 14 to return to its normal perpendicular position.

Figure 14:
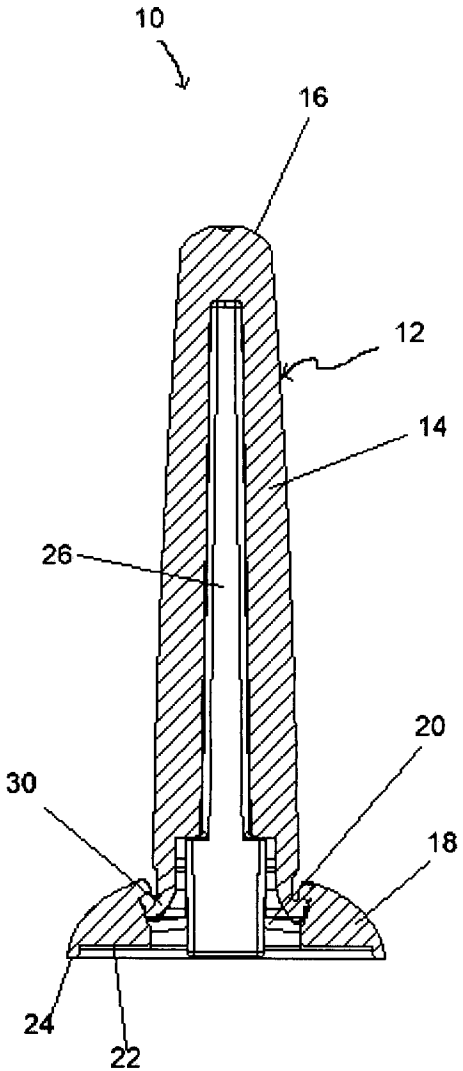
FIGS. 13 and 14 are longitudinal section views of the second embodiment of the doorstop in an axially compressed position.
Figure 13:
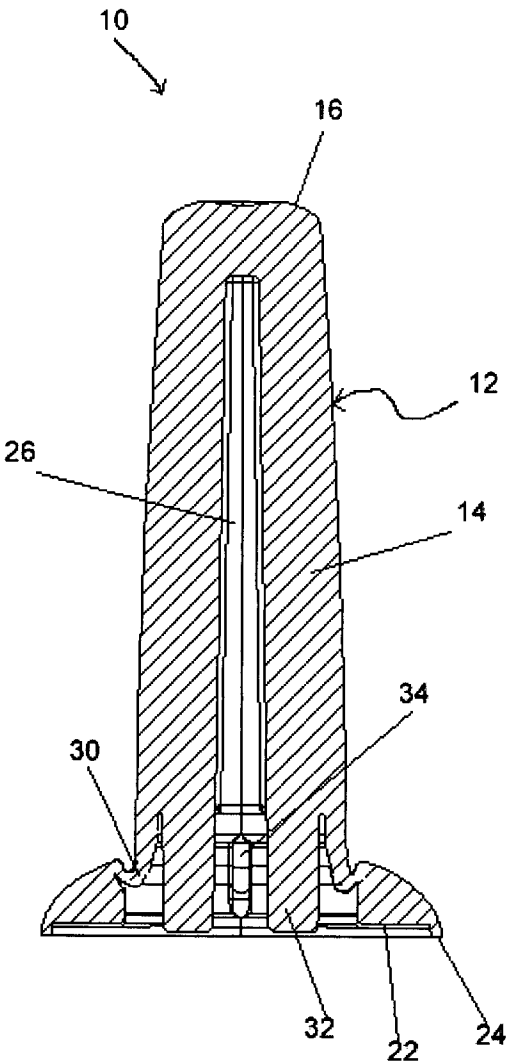
Figure 15:
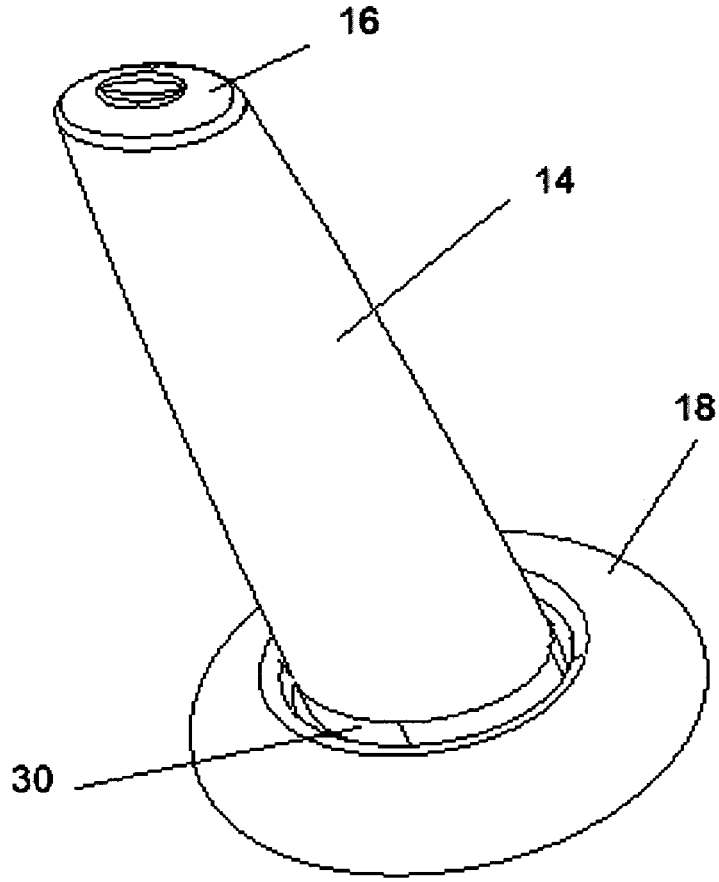
FIGS. 15 and 16 are perspective views of a third exemplary embodiment of the doorstop.
Figure 16:
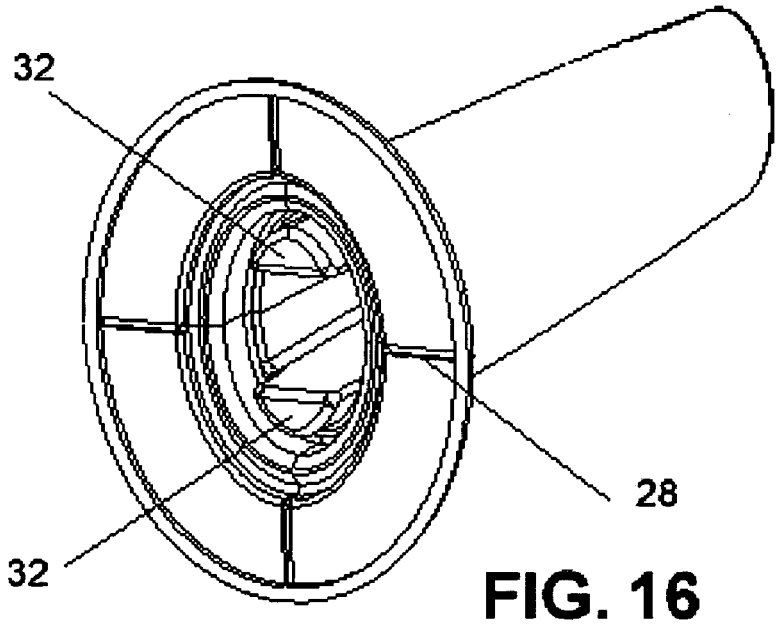

FIGS. 9 through 14 illustrate a second exemplary embodiment of the doorstop 10. The embodiment is similar to the first embodiment and therefore the same reference numbers have been used to designate similar parts. In the second embodiment shown in FIGS. 9 through 14, the doorstop 10 includes a unitary body 12 comprising a shank 14, tip 16 and base 18 as previously described. An air chamber 20 and axial bore 26 are formed in the unitary body 12. The second embodiment additionally includes internal bumpers 32 which, in a preferred embodiment, are integrally formed with the shank 14. In the uncompressed state shown in FIGS. 11 and 12, the ends of the bumpers 32 are spaced from the walls approximately ⅛" to ¼". When the shank 14 is compressed by axial forces as shown in FIGS. 13 and 14, the internal bumpers 32 engage the wall to prevent the shank 14 from being compressed to the point that the doorknob is allowed to strike the wall.

Figure 18:
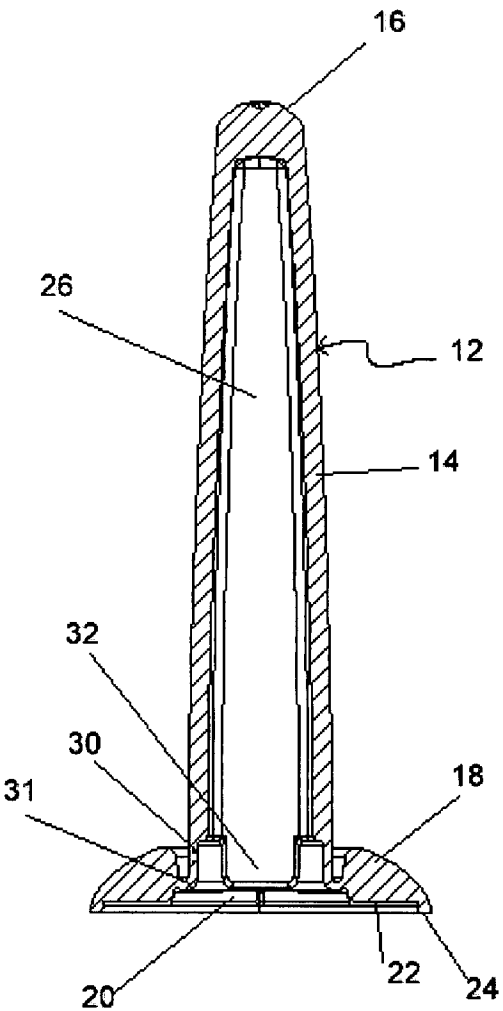
FIGS. 17 and 18 are longitudinal section views of the third embodiment of the doorstop in a normal uncompressed position.
Figure 17:
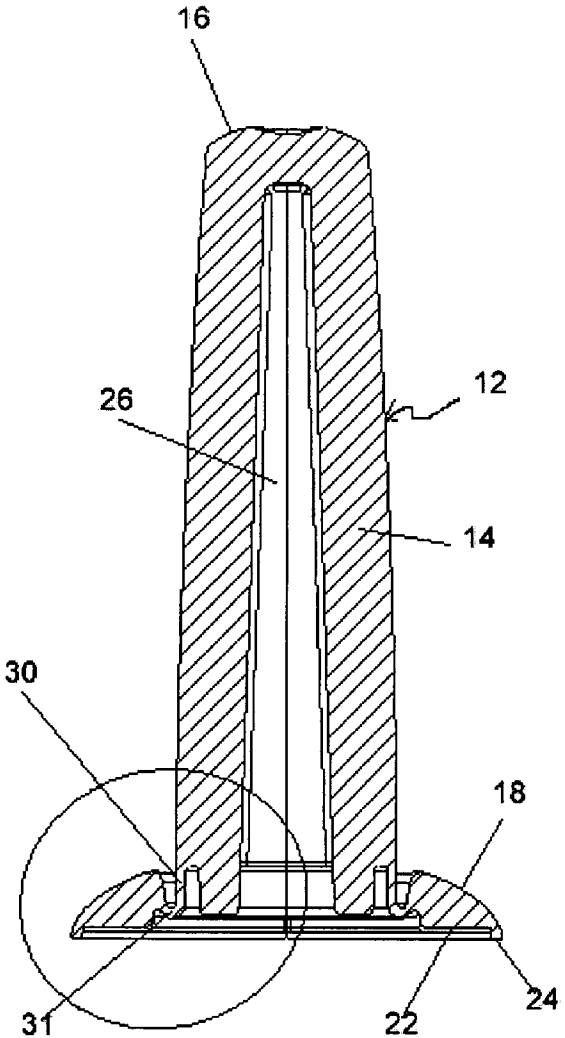
Figure 21:
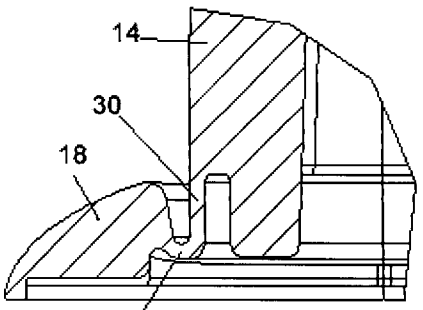
FIG. 21 is a detail view of the third embodiment of the doorstop in a normal uncompressed position.
Figure 20:
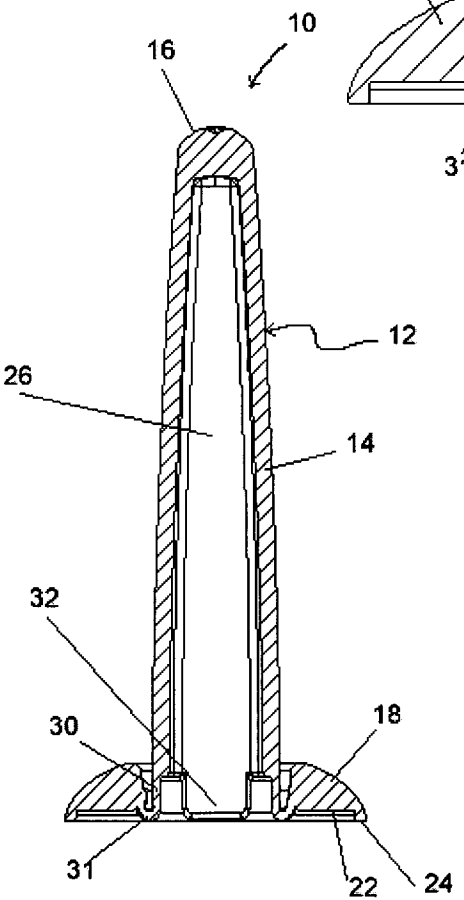
FIGS. 19 and 20 are longitudinal section views of the third embodiment of the doorstop in an axially compressed position.
Figure 19:
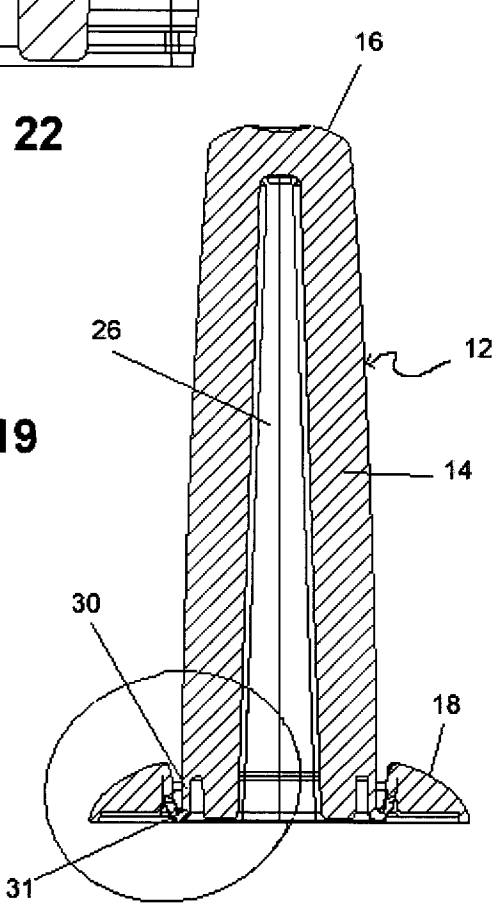
Figure 22:
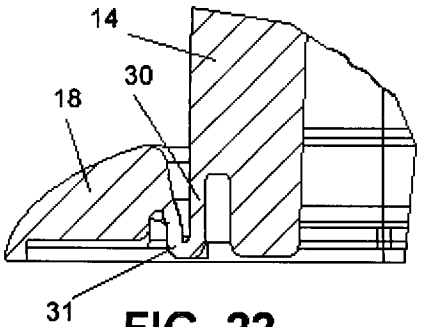
FIG. 22 is a detail view of the third embodiment of the doorstop in an axially compressed position.

FIGS. 15 through 22 illustrate a third exemplary embodiment of the doorstop 10. The third embodiment is similar to the embodiment of FIG. 2. Doorstop 10 includes a unitary body 12 having an elongate shank 14, a tip 16 for engaging the door, and a base 18 for mounting the doorstop 10 to a wall. The unitary body 12 includes an air chamber 20 and axial bore 26. The third embodiment further includes internal bumpers 32 as previously described. This embodiment differs from the other embodiments in that the flexible wall 30 includes a fold or crease 31, which is best seen in FIGS. 21 and 22. FIGS. 17, 18 and 21 show the doorstop 10 in an uncompressed state. FIGS. 19, 20 and 22 show the doorstop 10 in an axially compressed state. When an axial force is applied to the doorstop 10, the elongate shank 14 is pushed downwardly into the base 18. As the elongate shank 14 is pushed downwardly, the fold or crease 31 travels along the flexible wall 30. When the axial force is removed, the natural resiliency of the flexible wall 30 pushes the elongate shank 14 upward to its original position.

Figure 24:
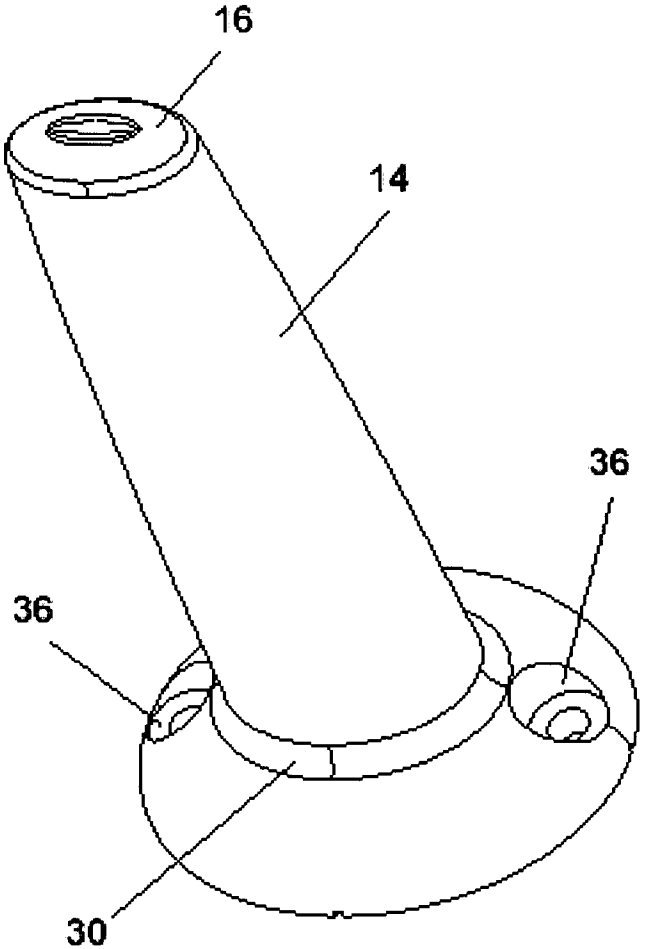
FIGS. 23 and 24 are perspective views of a fourth embodiment of the doorstop.
Figure 23:
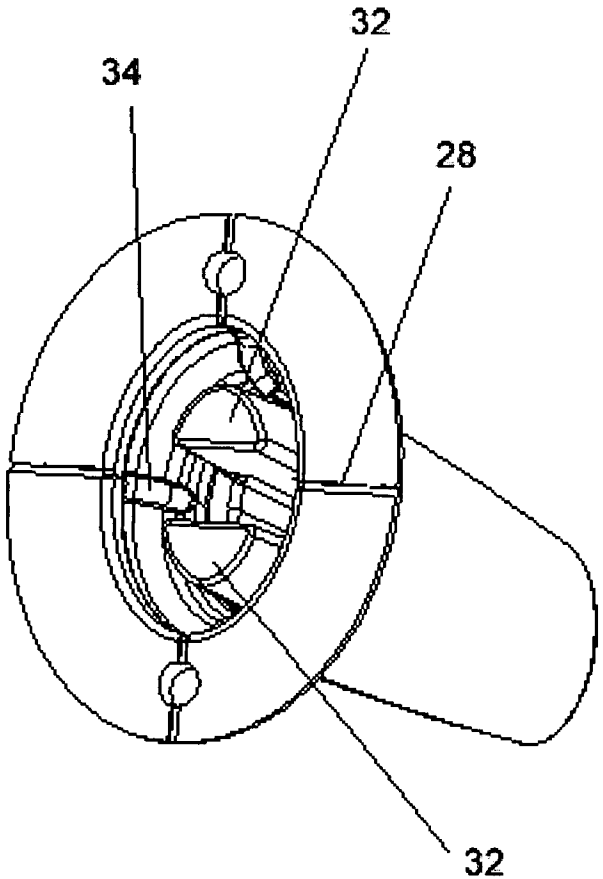
Figure 25:
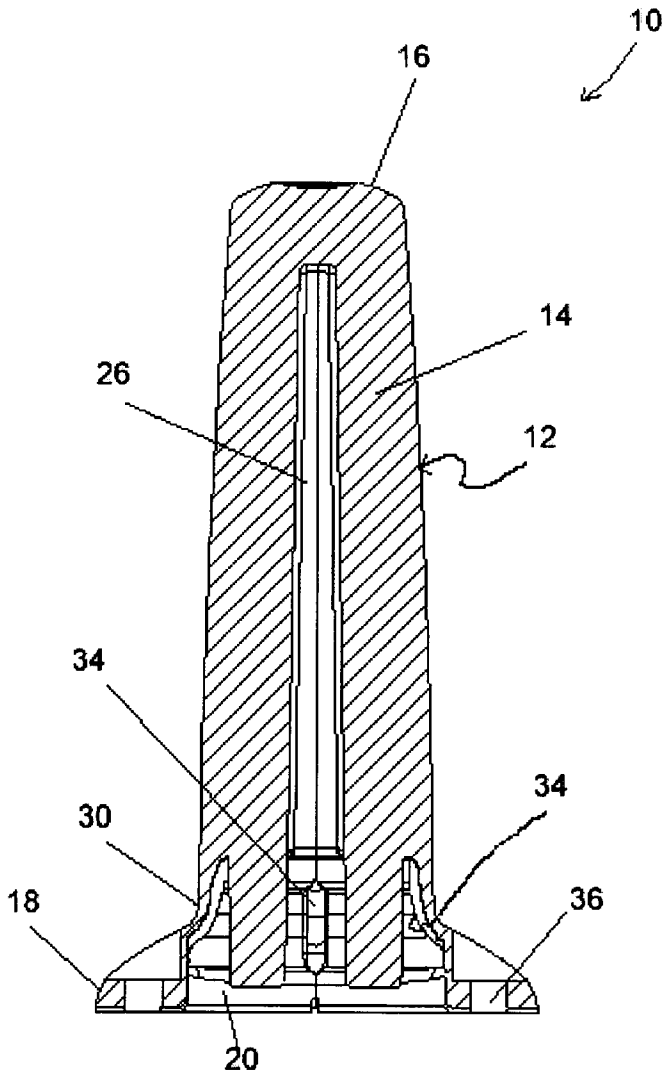
FIG. 25 is a longitudinal section view of the fourth embodiment of the doorstop in a normal uncompressed position.

FIGS. 23 through 25 illustrate a fourth exemplary embodiment of the doorstop 10. The fourth embodiment of FIG. 13 is similar to the second embodiment. The doorstop 10 includes a unitary body 12 comprising an elongate shank 14, a tip at one end of the elongate shank 14 for engaging the door, and a base 18 at the opposite end of the elongate shank 14 for mounting the doorstop 10 to the wall. The unitary body 12 includes an air chamber 20 and axial bore 26. The fourth embodiment further comprises screw holes 36 in the base 18 as an alternative means of mounting the doorstop 10 to a wall.

Various embodiments of the invention have been shown and described. The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

The invention claimed is:

1. A doorstop comprising:

a unitary body made of a resilient material, the body including:

an elongate shank having a longitudinal axis, wherein the length of the elongate shank is sufficient to engage a plane of a door while preventing a door knob on the door from contacting a wall to which the doorstop is mounted;

an air chamber having one closed end and one open end, the air chamber extending axially into the elongate shank to dampen the impact of the door along the longitudinal axis;

a base at one end of the elongate shank;

a plurality of air passages in the base communicating with the air chamber enabling air to exit the air chamber when the elongate shank is axially compressed and to enter the air chamber when the elongate shank returns to its normal position; and a flexible wall connecting said elongate shank to said base and configured to flex along the longitudinal axis in response to an impact by a surface of a door to absorb the impact of said door, and along a lateral axis substantially perpendicular to the longitudinal axis in response to lateral forces.

2. The doorstop of claim 1 wherein said flexible wall buckles outwardly in response to impact by a door along the longitudinal axis to allow said elongate shank to move in the axial direction.

3. The doorstop of claim 1 wherein said flexible wall includes a crease that travels along said wall in response to impact by a door along the longitudinal axis to allow said elongate shank to move downward into the base.

4. The doorstop of claim 1 wherein said flexible wall includes one or more support ribs.

5. The doorstop of claim 1 wherein said body further comprises one or more bumpers disposed within said air chamber for engaging said wall surface when said elongate shank is axially compressed to limit the axial compression of said elongate shank.

6. The doorstop of claim 1 wherein said flexible wall allows said elongate shank to fold back against said wall surface in response to lateral impact forces applied to said elongate shank.

7. The doorstop of claim 6 wherein said elongate member has a generally oval cross-section with a major axis and a minor axis.

8. The doorstop of claim 1 further comprising a mounting member for mounting said doorstop to said wall surface.

9. The doorstop of claim 8 wherein said mounting member comprises an adhesive disk that secures to a bottom surface of said base.

10. A doorstop comprising:

a base for mounting to a wall surface;

an elongate shank extending outwardly from said base along a longitudinal axis, wherein the length of the elongate shank is sufficient to engage a plane of a door while preventing a door knob on the door from contacting a wall to which the doorstop is mounted;

an air chamber having one closed end and one open end, the air chamber extending axially into the elongate shank to dampen the impact of the door along the longitudinal axis;

a plurality of air passages in the base communicating with the air chamber enabling air to exit the air chamber when the elongate shank is axially compressed and to enter the air chamber when the elongate shank returns to its normal position; and a flexible member connecting said elongate shank to said base, said flexible member configured to flex along the longitudinal axis in response to axial forces to allow axial compression of said elongate shank, and along a lateral axis substantially perpendicular to the longitudinal axis in response to lateral forces.

11. The doorstop of claim 10 further comprising one or more bumpers disposed within said air chamber for engaging said wall surface when said elongate shank is axially compressed to limit the axial compression of said elongate shank.

12. The doorstop of claim 10 wherein said flexible member allows said elongate shank to fold back against said wall surface in response to lateral impact forces applied to said elongate shank.

13. The doorstop of claim 10 wherein said elongate member has a generally oval cross-section with a major axis and a minor axis.

14. The doorstop of claim 10 further comprising a mounting member for mounting said doorstop to said wall surface.

15. The doorstop of claim 14 wherein said mounting member comprises an adhesive disk that secures to a bottom surface of said base.

* * * * *